United States Patent [19]

Schonbach et al.

[11] Patent Number: 4,934,900

[45] Date of Patent: Jun. 19, 1990

[54] ASSEMBLY FORMING A CYLINDRICAL CAGE OF SPACED APART VANES

[75] Inventors: Bernard H. Schonbach, Allentown; Roger A. Powell, Red Hill; Belle M. Lukacz; Stephen A. Lukacz, both of Nazareth, all of Pa.

[73] Assignee: Fuller Company, Bethlehem, Pa.

[21] Appl. No.: 387,262

[22] Filed: Jul. 31, 1989

[51] Int. Cl.[5] ..... F01D 9/04

[52] U.S. Cl. ..... 415/209.3; 415/186

[58] Field of Search ..... 415/186, 189, 190, 208.1, 415/208.2, 208.3, 209.2, 209.3, 209.4, 210.1, 211.1, 211.2

[56] References Cited

U.S. PATENT DOCUMENTS

| | | | |
|---|---|---|---|
| 2,245,237 | 6/1941 | Truex | 415/209.4 |
| 2,661,147 | 12/1953 | Anderson | 415/209.3 |
| 2,834,537 | 5/1958 | Neary | 415/209.3 |
| 2,856,118 | 10/1958 | Smith | 415/209.4 |
| 2,980,396 | 4/1961 | Movsesian | 415/189 |
| 3,004,750 | 10/1961 | Broders | 415/209.4 |
| 4,482,296 | 11/1984 | Wassell et al. | 416/216 |

FOREIGN PATENT DOCUMENTS

| | | | |
|---|---|---|---|
| 128499 | 6/1950 | Belgium | 415/216 |
| 729662 | 7/1932 | France | 415/217 |
| 17327 | 5/1971 | Japan | 415/190 |
| 267405 | 3/1927 | United Kingdom | 415/217 |
| 660383 | 11/1951 | United Kingdom | 415/190 |

*Primary Examiner*—Robert E. Garrett
*Assistant Examiner*—John T. Kwon
*Attorney, Agent, or Firm*—Daniel DeJoseph

[57] ABSTRACT

An assembly for a cylindrical cage which includes vanes made up of blades and end lugs. The end lugs and vanes are attached to a frame by a ring element with a fastener securing the ring element, end lug and blade to the frame. The end lugs are dimensioned and shaped so that when the end lugs of adjacent vanes are nested together, the vanes are spaced apart the desired amount and the angular relationship between vanes is maintained so that the gas flow path between adjacent vanes has the desired configuration. The blades can be made separate from or integral with the end lugs. The invention is particularly designed for use in mounting guide vanes in a cage type air classifier for classifying particulate materials.

17 Claims, 5 Drawing Sheets

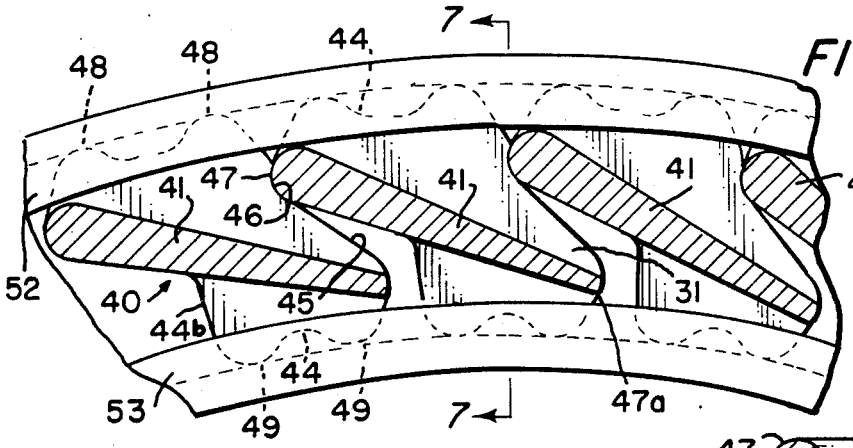
FIG. 6
FIG. 7
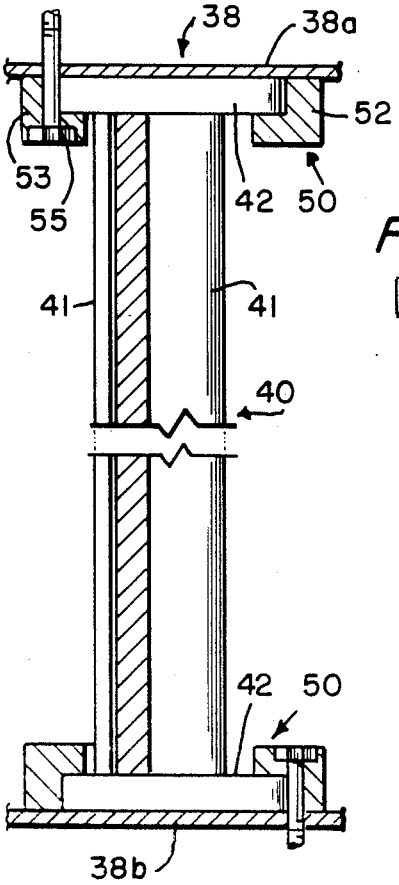
FIG. 8
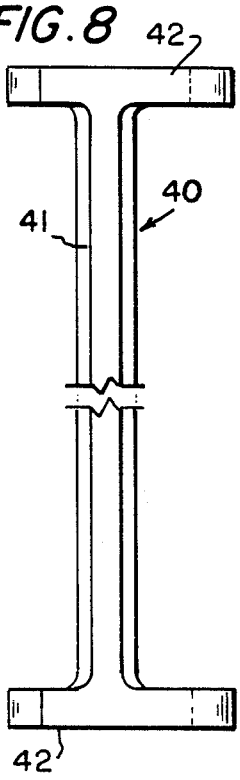
FIG. 10
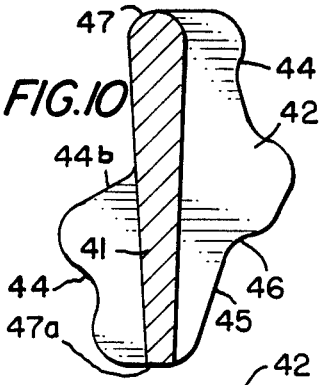
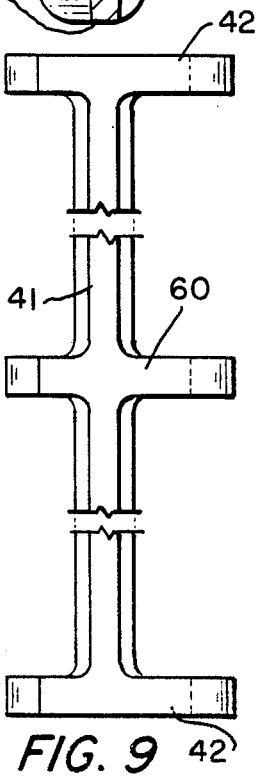
FIG. 9

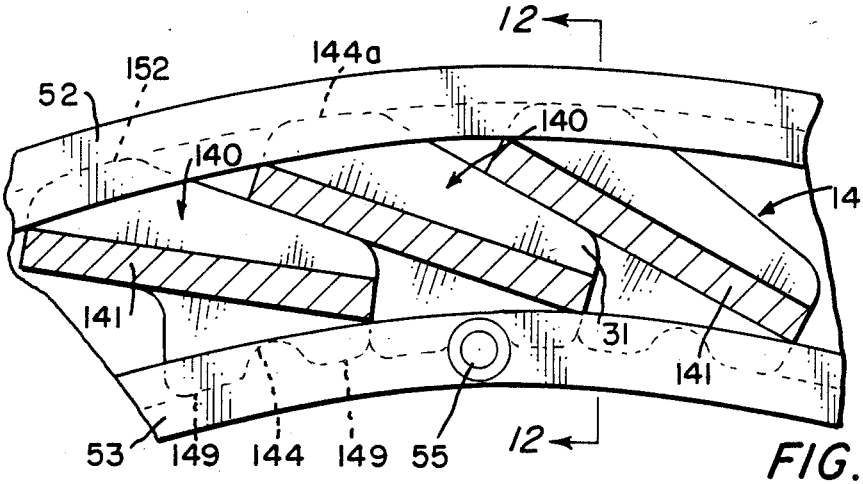
FIG. 11
FIG. 14
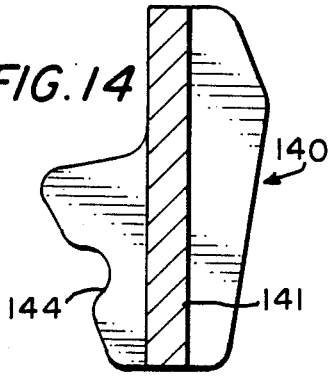
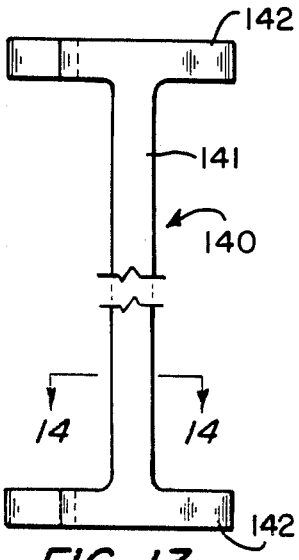
FIG. 13
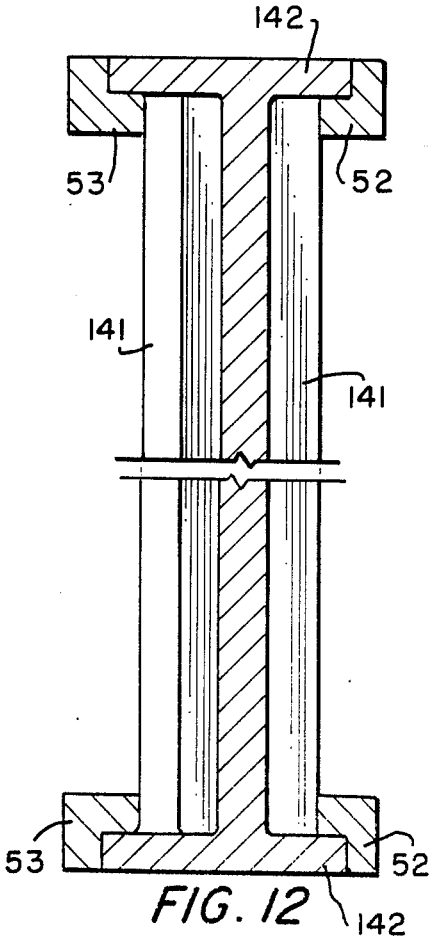
FIG. 12

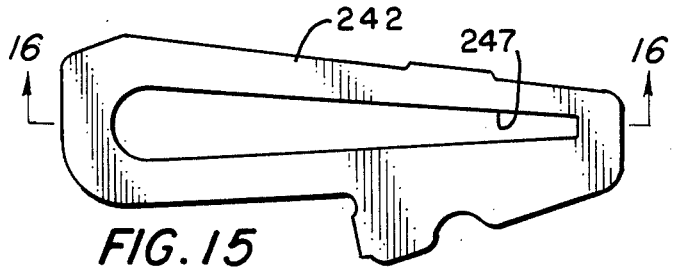
FIG. 15
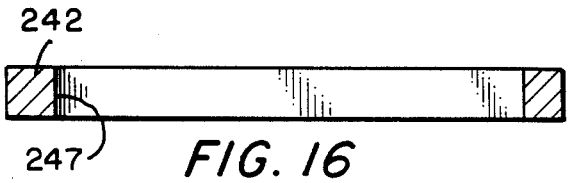
FIG. 16
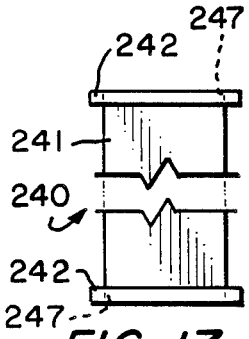
FIG. 17
FIG. 18
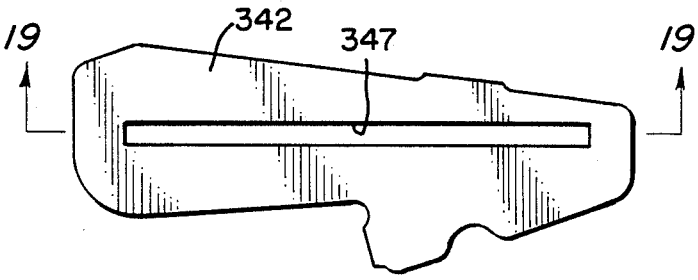
FIG. 19
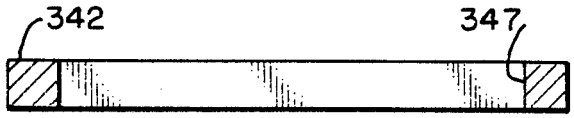
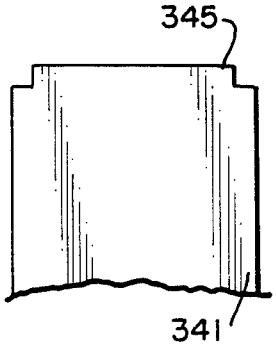
FIG. 20

ASSEMBLY FORMING A CYLINDRICAL CAGE OF SPACED APART VANES

BACKGROUND OF THE INVENTION

This invention relates to an assembly forming a cylindrical cage of spaced apart vanes which is particularly adapted for use in forming guide vanes for use in an air classifier. The classifier may be of the type used for classifying particulate material into a fine fraction and a coarse fraction. The invention is particularly adapted to use with an air classifying device of the type shown in U.S. Pat. No. 4,296,864, issued Oct. 27, 1981.

In air classifying devices of the type to which the present invention relates, there is provided a hollow body having a cage type rotor mounted therein with a motor for rotating the caged rotor. A tangential inlet for classifying air is provided. A plurality of guide vanes are mounted inside of the casing to form a cylindrical cage between the inlet for classifying air and the cage type rotor. These guide vanes serve to direct the classifying air and entrained material into the caged rotor in a tangential direction for classifying particulate material into a fine fraction and a coarse fraction. Details of the operation of the classifier will not be described herein but will be known to those skilled in the art. Other classifiers of this type are illustrated, for example, in U.S. Pat. Nos. 3,669,265; 2,758,713 and 3,015,392.

Common practice prior to the present invention was to utilize separate guide vanes or blades which may be secured as by welding to top and bottom ring members inside the classifier body to form a cylindrical cage. The guide vanes must be appropriately located to perform the dual functions of properly orienting the incoming air flow in a direction tangential to the spinning internal rotor or cage. The second function of the guide vanes is to provide a choked down area or flow path through the area between the guide vanes in order to accelerate the incoming air flow to a desired speed. Since this air flow is usually dust laden with an abrasive material such as ground cement clinker, the guide vanes will wear, necessitating periodic replacement. Since it is desirable to precisely locate the various vanes which make up the assembly, the individual vanes should be placed with a certain degree of precision to assure that the proper spacing and flow path design is achieved. Field replacement of worn vanes in a separator may require arc cutting of the worn vanes and replacement by welding.

In the past, most vanes have been flat metal pieces and in certain instances it would be desirable to shape the vanes in an air-foil shape to improve air flow through the guide vanes to provide for reduced air flow resistance and improve durability and wear resistance of the guide vanes. This could be accomplished by individually casting the guide vanes and then providing a means for positioning the vanes in place.

Since guide vanes are usually welded in place within the classifier, present designs require the use of a material which can be welded. It would be desirable to be able to form the guide vanes out of a wear resistant material which may not be suitable for welding.

U.S. Pat. No. 3,015,392 illustrates an air classifying device with an internal cage type rotor, a tangential classifying air inlet and guide vanes between the air inlet and the rotor. In this patent, the guide vanes have pins at each end which fit into a ring element. This arrangement necessitates the precise location of holes to receive the pins.

SUMMARY

It is the principal object of this invention to provide a vane for use in forming part of a cylindrical cage of spaced apart vanes.

It is a further object of this invention to provide an assembly forming spaced apart guide vanes of an air classifier which assembly allows for an improved vane design and improved assembly technique.

One purpose of the present invention is to provide a better means for affixing the guide vanes into an air classifier enclosure while offering a more streamlined shape which will create less resistance to air flow and thus minimizing the pressure differential across the guide vane assembly. This will improve performance of the air classifier. The desired shape of the guide vane is easily made available by casting it form a durable material which will resist normal wear. This will improve the classifier by increasing operating time before maintenance of the guide vanes is necessary.

In general, the foregoing and other objects will be carried out by providing an assembly forming spaced apart guide vanes of an air classifier wherein the assembled guide vanes surround the rotor of a cage type air classifier wherein classifying air flows from the outside of the assembly through the guide vanes toward the cage type rotor, said assembly comprising a plurality of guide vanes, each including an elongated blade and an end lug at each end of the blade; a pair of longitudinally spaced apart ring elements; the end lugs at one end of the guide vanes being operatively associated with one of said ring elements; and fastener means operatively associated with said ring elements for securing said ring element and said guide vanes to the air classifier; said end lugs being dimensioned to position the blades in said ring elements in a circumferentially spaced apart relationship to each other to surround the rotor in the classifier.

Broadly the present invention provides for a vane for use in forming part of any cylindrical cage wherein the cage is made up of a plurality of circumferentially spaced apart vanes. Each vane includes an elongated blade and an end lug at each end of the blade. There is a frame for the cage which may be formed by the body of an air classifier. A pair of longitudinally spaced apart ring elements are provided with one operatively associated with each end of the vane. The ring elements are designed to lie atop the end lugs. A fastener then secures the ring element and associated end lug and thus the guide vane to the frame. Each of the end lugs is dimensioned and shaped to nest together with other adjacent lugs to position the vane within the ring element so that the various rings are circumferentially spaced apart from each other to form the cylindrical cage.

By proper dimensioning and shaping of the end lugs, the guide vanes can be oriented with respect to each other to provide a flow path through the assembled cage of guide vanes which is less resistant to air flow than with prior designs. This shape may be such that the flow path is larger at the outer circumference of the cage as compared with the inner circumference of the cage. The blade of the guide vane can be cast in a desired shape such as a generally air foil shape. The end lugs can be cast integral with or separate from the blades. By the use of castings, the blades can be made of a special wear resistant materials such as a ceramic but such material may not be suitable for welding. This is particularly important where the invention is used in association with an air classifier handling a abrasive material such as cement clinker.

The ring elements supporting the ends of the guide vanes may be arcuate angle members which, when joined together, form a annular ring. Segmented rings may be used to allow the removal and replacement of only those guide vanes which might be worn without removing the entire assembly. Further, the repair and replacement can be made using hand tools without the need for cutting torches and welding equipment.

BRIEF DESCRIPTION OF THE DRAWINGS

The invention will be described in connection with the annexed drawings wherein:

FIG. 6 is a sectional view of an assembly of guide vanes with the vanes nested together to show a portion of a cylindrical cage according to the present invention;

FIG. 7 is a sectional view taken on the line 7—7 of FIG. 6;

FIGS. 8 and 9 are detailed views of two embodiments of guide vanes according to the present invention;

FIG. 10 is a sectional view of an individual guide vane according to the present invention when removed from the ring assembly illustrating a preferred shape of the lugs;

FIG. 11 is a sectional view of a portion of a modified embodiment of the present invention with vanes nested in spaced apart relationship to each other;

FIG. 12 is a sectional view taken on the line 12—12 of FIG. 11 showing a modified embodiment of the present invention.

FIG. 13 is a view of a guide vane according to the present invention positioned within the ring assembly;

FIG. 14 is a sectional view taken on the line 14—14 of FIG. 13 showing the shape of an end lug;

FIG. 15 is a plan view of a lug for a guide vane utilized in the present invention;

FIG. 16 is a sectional view taken on the line 16—16 of FIG. 15;

FIG. 17 is a view on a reduced scale of a guide vane which may utilize the end lugs having a shape illustrated in FIGS. 15 and 16;

FIG. 18 is a view similar to FIG. 15 showing a modified end lug;

FIG. 19 is a sectional view taken on the line 19—19 of FIG. 18; and

FIG. 20 is a view of a blade for a guide vane on a reduced scale to be utilized with the lug of FIGS. 18 and 19.

DESCRIPTION OF THE PREFERRED EMBODIMENTS

Figure 1:
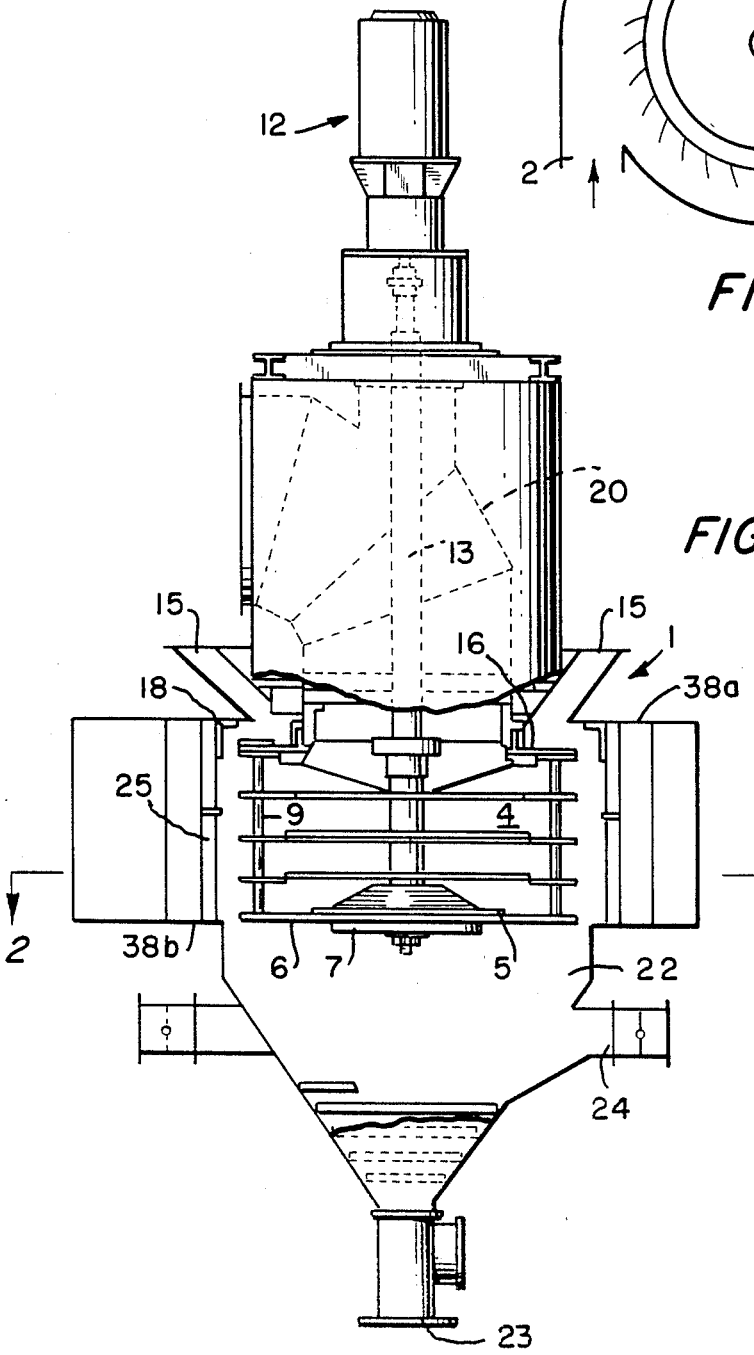
FIG. 1 is a diagramatic view of an air classifying device utilizing the present invention.

The present invention is designed particularly for use in a cage type air classifying device such as that illustrated in FIG. 1. This device is substantially as described in U.S. Pat. No. 4,296,864. The separator includes a cylindrical body generally indicated at 1 having a tangential inlet 2 for classifying air and a secondary tangential inlet 3 also for classifying air. The central space 4 inside the body 1 constitutes a classification chamber. A cage type rotor 5 is mounted for rotation within the classification chamber inside the classifier body. This rotor includes a cage having a plurality of annular partitions 6 and a distribution member 7 with a plurality of circumferentially spaced apart vertically oriented flow adjusting blades 9. A motor means generally indicated at 12 is connected by means of a shaft 13 to rotate the rotor 5. A plurality of vertically oriented, circumferentially spaced apart guide vanes 25 are mounted inside the body 1 to form a cylindrical cage surrounding and spaced from the rotor 5. Material to be classified is supplied through inlets 15 to a distribution plate 16 integral with the rotor 5. Centrifugal force generated by the distribution plate will throw the material against a buffer plate 18. Classifying air which may contain additional powder material to be classified enters the classifier body through inlets 2 and 3 and flows through guide vanes 25 for orienting the incoming air flow in a direction tangential to the spinning rotor 5. The blades also serve to accelerate the incoming air flow to a desired speed.

Material which is supplied through inlet 15 falls between the guide vanes 25 and the rotor 5 and is carried into the classification chamber 4 for classification. The fine fraction of the material is discharged through outlet duct 20 which is flow connected to a high efficiency dust collector. The coarse fraction of the material is discharged to a hopper 22 and from the hopper 22 to an outlet 23. A rotary air lock (not shown) may be provided in the outlet 23 in a manner known to those skilled in the art. Tertiary air may be supplied through a pair of valved inlets 24 in a manner described in the aforesaid U.S. Pat. No. 4,296,864.

Figure 2:
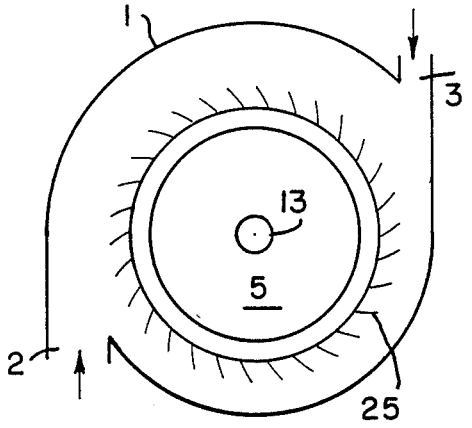
FIG. 2 is a diagramatic sectional view taken on line 2—2 of FIG. 1 illustrating the orientation of the guide vanes relative to the classifier body, the inlet for classifying air and the cage type rotor.
Figure 3:
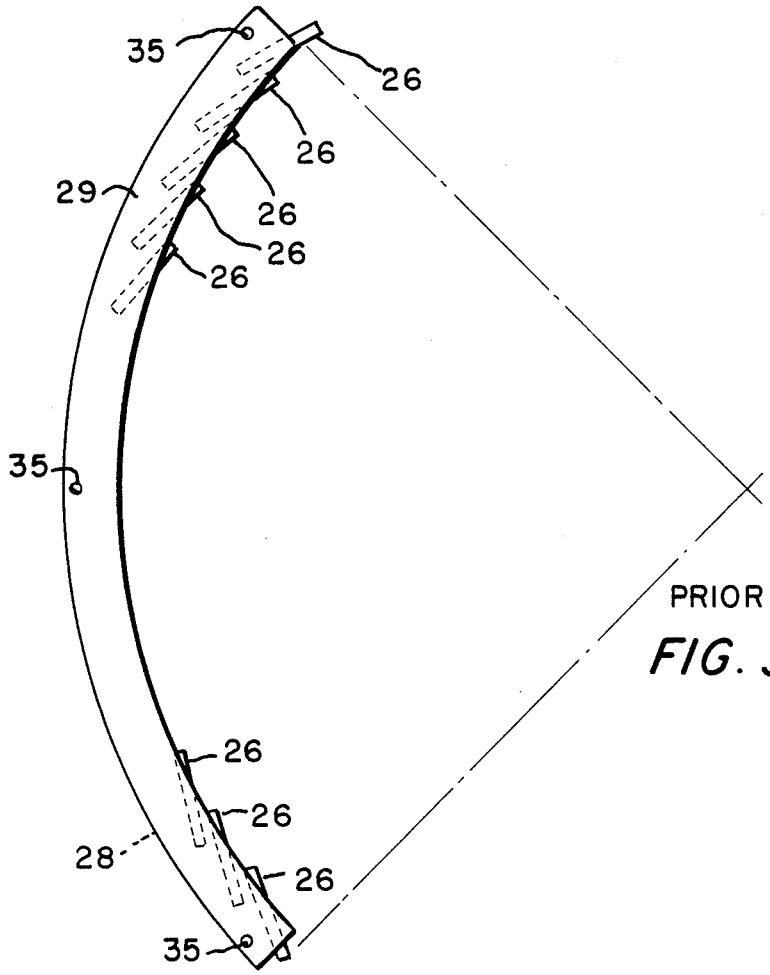
PRIOR ART FIG. 3
FIG. 3 is a fragmentary view of the prior art guide vanes.
Figure 5:
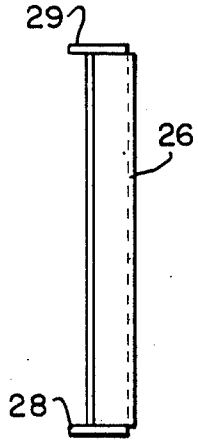
PRIOR ART FIG. 5
FIG. 5 is a view of a guide vane utilized by the prior art.
Figure 4:
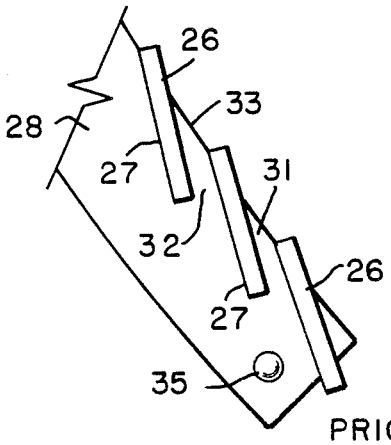
PRIOR ART FIG. 4
FIG. 4 is an enlarged view of a portion of the prior art.

Referring to FIGS. 3 to 5, typical guide vanes 25 of the prior art are flat plates or blades 26 which are secured by welding at 27 to a lower ring member 28 and an upper ring member 29. The guide vanes define a flow path 31 between adjacent blades. The flow path may be larger at 32 at the outside of the guide vanes than it is at 33 at the inside of the guide vanes so that classifying air is accelerated as it flows between the guide vanes. The guide vanes form an annular cage as shown in FIG. 2, but only a portion of the cage is illustrated in FIG. 3. The rings 28 and 29 may be secured by fasteners 35 to the inside of the classifier body 1. If desired, the ring members 28 and 29 may be segmented as illustrated in FIG. 3.

The present invention provides an improved assembly forming a cylindrical cage of spaced apart vanes. These vanes, when assembled, form a cylindrical cage member which may surround the rotor of a cage type air classifier wherein classifying air (either pure air or dust laden) flows from the outside of the assembly tangentially between the guide vanes to the classifying chamber. Referring to FIGS. 6 to 10 a first embodiment of the present invention is illustrated. In this embodiment the means defining a frame or the body of the separator is illustrated at 38 and may have a top 38*a* and a bottom 38*b* and may form part of the classifier body 1.

Each of the guide vanes is generally indicated at 40 and includes an elongated blade 41 which in FIGS. 6 to 10 is illustrated as generally air-foil shaped in cross-section to improve air flow across the vane. The guide vane 40 includes a pair of end lugs 42 each operatively associated with one end of the blade 41. In the embodiment illustrated in FIGS. 6 to 10, the end lugs 42 are integral with the blade 41 and the blade and end lugs may be cast as a unitary piece. If desired, the blades could be cast as a curve to further improve the air flow across the blades.

The shape of end lug 42 is best illustrated in FIGS. 6 and 10 and includes edges which are of a camel hump shape as indicated at 44 and have inwardly curved sides 44*b* and 45. The blade member 41 extends diagonally between these two camel hump shaped ends 44 from side 45*b* to side 45. One side 45 of the end lug 42 includes an indentation at 46 which may have a shape which conforms with the leading edge 47 of the blade 41. In FIGS. 6 to 10, the leading edge 47 is rounded. The trailing edge 47*a* is spaced from the side 44*b* of an adjacent lug 42 and guide vane 40.

The assembly includes a pair of longitudinally spaced apart ring elements each generally indicated at 50. These ring elements are formed by a pair of concentric radially spaced apart arcuate angle members or ring segments 52 and 53 each adapted to lie atop an end lug 12 at one end of the vane 10 as best illustrated in FIGS. 6 and 7. A fastener means 55 is operatively associated with each angle member of the ring elements 50 for securing the ring elements and the guide vanes 40 to the air classifier or frame 38.

The vanes 40 are axially constrained by the body top 38*a* and bottom 38*b*. Therefore, if desired, the ring segments 52 and 53 can be fabricated without a clamping feature. Instead of using angle members, an annular bar could be used for fixing the vane in a radial position.

As can be seen from FIG. 6, the edge 47 of one blade will align itself with the indentation 46 in an adjacent end lug. As can be seen best in FIG. 6, the camel's hump configuration provides a two point contact at 48 with ring member 52 and a two point contact at 49 with ring member 53. If desired, the faster means 55 may extend through the indentation in the camel's hump configuration 44 as illustrated in FIG. 11.

The end lugs 42 are dimensioned and shaped to nest together to position adjacent blades in the ring elements in circumferentially spaced apart relationship to each other and is a predetermined angular relationship to each other to form the cylindrical cage.

The shape and dimensioning of the lugs 42 serves to space the guide vanes in relation to each other so that the flow path 31 between adjacent guide vanes can be shaped as desired such as to accelerate the gas flow through the cage by having the outside of the flow path 31 wider than the inside as illustrated in FIG. 6. The advantage of the lugs 42 is that once the desired shape is designed, the vanes including blades and lugs can be mass produced, then individual guide vanes are nested together in the ring members 50 to form the cylindrical cage of guide vanes.

In the embodiment of FIG. 9, there is provided a spacer lug 60 positioned on the blade 11 intermediate to the end lugs 42. This is particularly useful when the guide vanes 10 are long so throughout the length of the guide vane. In addition, the intermediate lugs aid in substantially preventing vibration of the blades 41 by providing circumferential support.

The design of the present invention has the advantage that the guide vanes 40 may be cast of a suitable wear resistant material. Further, with the present invention because the guide vanes 40 are attached to the frame 38 by the ring members 50, the guide vanes 40 can be cast of wear resistant materials which will withstand the abrasive nature of the material being classified such as cement clinker. This is particularly important where the classifying air admitted at inlets 2 and 3 contain additional material to be classified and the air which flows between the vanes contains the abrasive material. These wear resistant materials may not be suitable for welding to the frame member, but the assembly configuration of this invention does not require that easily weldable material be used to manufacture the blades.

An alternate embodiment of the present invention is illustrated in FIGS. 11 to 14. In this embodiment, the end lugs may include only a single camel hump arrangement 144 which provides two point contact at the inner ring 53 as illustrated at 149. The outer ring includes a generally single point contact at 152 as a flat end 144*a* is used in this embodiment. It should also be noted that in this case, the blade 141 is illustrated as substantially flat in cross section but an air foil shape could be used. Also in this configuration the air flow passage 31 between adjacent guide vanes 110 narrows from the outside of the cage towards the inside of the cage to accelerate air flow between blade 141. In this embodiment the end lug 142 is integral with blade 141.

A further modification of the present invention is illustrated in FIGS. 15 to 17. In this case, the end lugs 242 are separate from the blade 241 and the complete assembled guide vane 240 is not assembled until the unit is put together. In this case, an opening 247 is provided which conforms to the shape of the end of blade 241 so that the end of the blade fits inside the end lug 242. This allows the blade 241 to be made separate from the end lugs 242 and enables the blade to be manufactured from a different material than the lugs.

A still further embodiment as illustrated in FIGS. 18 to 20 wherein a similar opening 347 is provided in a end plate 342. In this case, the blade 341 has a smaller end 345 to match the opening 347.

Other configurations of blades and end lugs are within the scope of the present invention.

The invention has been described based upon a tangential flow of classifying air through tangential inlets 2 and 3, but it is to be understood that the disclosed guide vanes will function effectively if the incoming air flow is radial or axial. Such an arrangement of guide vanes is shown for example in U.S. Pat. No. 4,597,537.

From the foregoing, it should be apparent that the objects of the present invention have been carried out. A novel assembly of guide vanes to produce a cylindrical cage has been provided. The arrangement permits easy replacement of some of the blades or an entire cage assembly. The fasteners 55 can be removed to remove one of the angle members in the area of worn vanes. The worn vanes can be removed and replaced. Since all end lugs are identical a new vane can be inserted in the precise desired position substantially without measurement and precise welding. This will assure uniform air flow into the classification chamber of the classifier.

It is intended that the foregoing be a description of preferred embodiments and that the invention be limited solely by that which is within the scope of the appended claims.

We claim:

1. An assembly forming a cylindrical cage of spaced apart vanes comprising a plurality of elongated blades; a pair of longitudinally spaced apart ring elements; a plurality of end lugs, each associated with an end of one of the blade and with one of the ring elements; each blade and an associated end lug at each end thereof forming a vane; each of said end lugs being positioned in said ring element and dimensioned and shaped to nest together with adjacent end lugs to position the vanes in said ring elements in circumferentially spaced apart and predetermined angular relationship to each other to form the cylindrical cage.

2. An assembly in accordance with claim 1 wherein each of said ring elements includes a pair of concentric, radially spaced apart arcuate angle members each adapted to hold the end lugs associated with one end of the blades.

3. An assembly in accordance with claim 2 wherein each of said end lugs is shaped to provide two point contact with at least one of said angle members.

4. An assembly in accordance with claim 3 wherein each of said end lugs is integral with one end of a blade.

5. An assembly in accordance with claim 4 further comprising a spacer lug integral with each blade intermediate the ends of said blade.

6. An assembly in accordance with claim 1 wherein each of said end lugs is a plate having an opening therein which conforms to the shape of the end of the blade and the end of the blade fits into the opening in the plate.

7. An assembly in accordance with claim 6 wherein said blades are generally air-foil shaped.

8. An assembly forming spaced apart guide vanes of an air classifier wherein the assembled guide vanes surround the rotor of a cage type air classifier wherein classifying air flows from the outside of the assembly through the guide vanes toward the cage type rotor, said assembly comprising a plurality of guide vanes, each including an elongated blade and an end lug at each end of the blade; a pair of longitudinally spaced apart ring elements; the end lugs at one end of the guide vanes being operatively associated with one of said ring elements; and fastener means operatively associated with said ring elements for securing said ring element and said guide vanes to the air classifier; said end lugs being dimensioned to position the blades in said ring elements in a circumferentially spaced apart and predetermined angular relationship to each other to surround the rotor in the classifier.

9. An assembly according to claim 8 wherein each of said lugs includes means defining a par of concentric annular angle members, each lying atop the end lugs and said fastener means secures said annular angles to the air classifier.

10. An assembly according to claim 9 wherein said end lugs are shaped to provide two point contact with at least one of said annular angle members.

11. An assembly according to claim 9 wherein said end lugs are integral with said blades.

12. An assembly according to claim 11 wherein each of said guide vanes includes a spacer lug integral with the blade intermediate the end lugs.

13. An assembly according to claim 9 wherein each of the end lugs is a plate having an opening therein which conforms to the shape of the end of the blade and the end of the blade fits into said opening.

14. An assembly according to claim 13 wherein said end lugs are shaped to provide two point contact with at least one of said annular angle members.

15. An assembly according to claim 9 wherein said blade is generally air-foil shaped.

16. An assembly according to claim 9 wherein said end lugs are shaped so that adjacent guide vanes define a gas flow path which narrows from the outside of the cage toward the inside of the cage.

17. An assembly forming a cylindrical cage of spaced apart vanes comprising means defining a frame, a plurality of elongated blades; a pair of longitudinally spaced apart ring elements; a plurality of lugs, each operatively associated with one end of one blade and with one of said ring elements; and fasteners operatively associated with said ring elements for securing said lugs and said blades to said frame said lugs being dimensioned to position said blades in said ring elements in circumferentially spaced apart relationship to each other to form the cylindrical cage.

* * * * *